United States Patent [19]

Blalock et al.

[11] Patent Number: 4,586,934

[45] Date of Patent: May 6, 1986

[54] PROCESS AND APPARATUS FOR COLORING TEXTILE YARNS

[75] Inventors: Paul B. Blalock; William C. Schwartz, both of Greensboro, N.C.

[73] Assignee: Burlington Industries, Inc., Greensboro, N.C.

[21] Appl. No.: 714,869

[22] Filed: Mar. 22, 1985

Related U.S. Application Data

[63] Continuation-in-part of Ser. No. 592,295, Mar. 22, 1984, abandoned.

[51] Int. Cl.[4] ..... D06P 5/00

[52] U.S. Cl. ..... 8/483; 8/151.2; 8/484; 8/523; 8/637; 68/19; 427/359; 427/389.8

[58] Field of Search ..... 8/483, 523, 637

[56] References Cited

U.S. PATENT DOCUMENTS

| | | | |
|---|---|---|---|
| 2,823,092 | 2/1958 | Spencer | 8/482 |
| 3,496,009 | 2/1970 | Hilbert et al. | 8/523 |
| 3,589,854 | 6/1971 | Cobb et al. | 8/154 |
| 3,591,408 | 7/1971 | Marzocchi et al. | 8/523 |
| 3,644,969 | 2/1972 | Guillermin et al. | 28/255 |
| 3,726,640 | 4/1973 | Takriti et al. | 8/483 |
| 3,775,054 | 11/1973 | DeVinney | 8/149 |
| 3,814,618 | 6/1974 | Kimpel et al. | 8/523 |
| 3,921,377 | 11/1975 | Snyder | 8/149 |
| 3,950,123 | 4/1976 | Somers et al. | 425/500 |
| 3,967,015 | 6/1976 | Hunsucker | 8/523 |
| 4,045,601 | 8/1977 | Brodmann et al. | 8/523 |
| 4,056,353 | 11/1977 | Bent et al. | 8/482 |
| 4,087,242 | 5/1978 | Frank et al. | 8/478 |
| 4,241,112 | 12/1980 | Kostandov et al. | 427/389.8 |
| 4,246,668 | 1/1981 | Spillmann et al. | 8/149 |

FOREIGN PATENT DOCUMENTS

| | | |
|---|---|---|
| 1488046 | 5/1967 | France . |
| 2064597 | 12/1980 | United Kingdom . |

*Primary Examiner*—A. Lionel Clingman

*Attorney, Agent, or Firm*—Cushman, Darby & Cushman

[57] ABSTRACT

Method and apparatus for producing textile yarns so that one surface of the yarn exhibits a visually perceptive darker color hue when compared to another surface of the yarn. The yarn surfaces are coated with a colorant-containing liquid (e.g. a dye- or pigment-containing liquid) and are subsequently dried to effect a drying rate differential between the one and another surfaces to cause the colorants to migrate towards the faster-drying surface to a degree sufficient to achieve the darker color hue thereon. Twisting of the produced yarns during packaging and/or weaving will thus create a woven textile fabric having randomly distributed color variations to achieve a visually pleasing striated, tone-on-tone or heather fabric appearance.

53 Claims, 3 Drawing Figures

PROCESS AND APPARATUS FOR COLORING TEXTILE YARNS

CROSS-REFERENCE TO RELATED APPLICATIONS

This application is a continuation-in-part of copending U.S. application Ser. No. 592,295 filed Mar. 22, 1984, and now abandoned the entire disclosure of which is expressly incorporated hereinto by reference.

BACKGROUND AND SUMMARY OF THE PRESENT INVENTION

Introduction

The present invention generally relates to a process and apparatus for coloring textile yarns to produce a tone-on-tone or striated appearance when such yarns are utilized to form a woven fabric. Thus, when woven into a fabric, the yarns of the present invention produce a very noticeable and aesthetically pleasing tone-on-tone, striated, or heather-like appearance. Fabrics of this type find particular utility for window shades and vertical blinds, or as facings for wall covering or other decorative purposes.

In accordance with the present invention, a textile yarn is coated or otherwise brought into contact with a colorant-containing liquid. Subsequently, the coated yarn is dried so that one portion of the yarn surface is dried at a faster rate than the drying rate of another portion of the yarn surface. Such a differential drying rate between the yarn surface portions will effect migration of the colorant to that portion of the yarn surface dried at a faster drying rate to a degree sufficient to achieve a visually perceptive darker color hue thereat when compared to other yarn surface portions. Twisting of the yarn during packaging and/or weaving will randomly distribute the darker color hue surface along the yarn's length. Thus, woven fabrics of the twisted yarn will be visually striated in coloring appearance.

Information Disclosure Statement

Other methods capable of producing multi-colored or tone-on-tone effects on fabrics or yarn exist. One conventional process utilized in Euorope reportedly involves the package dyeing of glass sliver yarns to produce a tone-on-tone colored yarn. Package dyeing is a process in which a dyebath is pumped under pressure through a package of yarn wound on a perforated tube. The dyebath solution is thus forceably pumped through the cross-section of the yarn package. The yarn produced in this conventional manner is not without its problems, however. Considerable variation in color over the cross-section of the yarn package may occur, the color becoming progressively lighter towards the low pressure side of the yarn package. Since the yarn packages are small (e.g. averaging about 4–5 pounds) there may also be undesirable color variation from package to package.

Other attempts at achieving straited tone-on-tone yarn or fabric appearances exist in the patent literature as evidenced by U.S. Pat. Nos. 3,775,054 to DeVinney; 3,950,132 to Somers et al; 4,087,242 to Frank et al; 4,246,668 to Spillmann et al; 2,823,092 to Spencer; 3,644,969 to Guillermann et al; and 3,726,640 to Takriti et al.

DeVinney '054 discloses a process whereby yarns with random color variation can be produced by applying dye using a rotating brush member. The differential speed between the linear speed of the rotating brush tips and the linear speed of the moving yarns determines the blending effect of the applied dye with respect to the basic color characteristics of the yarns.

Somers et al '132 disclose a random dyeing method wherein the yarns are laid in a zig-zag fashion and passed through a pair of dye-application rollers.

Frank et al '242 relates to a method of providing variegated dyed yarns which includes, in a preliminary step, passing a partially oriented polyester feeder yarn over a surface which is wetted with a liquid reagent. The liquid reagent alters the affinity of the yarn to a disperse dye and thus when the feeder yarn is dyed, the area treated with the reagent will be intermittently darker due to the increased dye affinity thereof.

Spillman et al '668 discloses wherein a number of webs of material are guided in a side-by-side fashion between treatment rollers. The treatment pressure is set differently at individual longitudinal portions of the roller nip so that the web of material is exposed to different treatment pressure at different points with the result that dye or other finishes are forced out of those portions of the web subjected to the greatest pressure and into those portions subjected to the least pressure.

Spencer '092 discloses a method whereby so-called "marbled" open-width cloth can be produced by compressing the cloth width-wise into a rope form and subsequently passing the compressed cloth while in such rope form lengthwise through a padding zone. The surface of the cloth in the padding zone will therefore acquire a random localized application of multi-tone color in spaced isolated portions thereof so as to establish the "marbled" appearance when the cloth is subsequently reopened to its full width.

Guillermann et al '969 discloses a method whereby thermoplastic yarn can be fed into a confined space so as to form a long stack of uniform cross-section of folded yarn. A dye solution is then fed at different locations to the same cross-section of the stack so the resulting intensity of the color of the yarn due to each dye falls off across the stack from the point of application.

Takriti et al '640 discloses a method wherein color patterns can be formed on e.g. carpets by application of dye droplets in an equal volume over the surface of the carpet breadth.

SUMMARY OF THE PRESENT INVENTION

The present invention provides a novel process for producing striated or tone-on-tone colored textile yarns for weaving into fabrics so that the resulting woven fabrics exhibit a notable tone-on-tone, striated, or heather-like appearance. In accordance with the present invention therefore, a striated colored yarn which is consistent in color and which exhibits a large degree of contrast between the dark and light areas of the yarn can be produced. Moreover, various weights and yarn sizes can be processed to produce a striated colored textile yarn of the present invention.

The striated colored textile yarn of the present invention can be produced in virtually unlimited package sizes and exhibits good light fastness and heat stability. Other desired properties including durability to washing, flame retardancy, water, stain and abrasion resistances can be imparted to the yarn in dependence upon the selected components of the yarn treatment bath.

Virtually all textile yarns can be treated in the manner of the present invention. For example, natural yarns of cotton, synthetic yarns of polyester or nylon and blends of such natural and synthetic yarns can be advantageously treated in accordance with the present invention so long as the textile yarns are capable of absorbing a colorant-containing liquid.

The "colorant" in the liquid can be either a dyestuff (natural and/or synthetic) or a pigment. When pigments are utilized as a colorant, it is typically desirable to include a resin component in the liquid to act as a binder for the pigments to ensure proper adhesion to the textile yarn. For example, when treating glass sliver yarns in accordance with the present invention, it is particularly preferred to utilize a pigmented liquid resin.

The glass sliver yarns are preferably contacted with a pigmented resin bath comprising an acrylic resin, suitable pigments for coloring, and other auxiliary chemical components including silane, surfactants, and softners. The yarns are then dried according to the present invention, for example, by means of a heated cylinder, to promote pigment migration to that side of the yarn in direct contact with the cylinder. The colored yarn exiting the drying cylinder has a ribbon-like form with one side being noticeably darker in color hue when compared to the other side thereof. However, as indicated above, other synthetic and nautral textile yarns could also be treated by a nonresinous dye bath suitable for the particular yarns utilized so long as the "differential" drying rate is maintained to cause colorant migration towards the heat source (e.g. to the yarn side adjacent the heated drum).

The treated yarn is then wound on a conventional package (e.g. yarn package core) suitable for weaving. When woven into a fabric, a very pleasing randomly striated, tone-on-tone, or heather-like appearance is achieved. Varying degrees of color contrast can be achieved by altering the components in the pigmented liquid bath and by utilizing different temperatures on the drying cylinder.

BRIEF DESCRIPTION OF THE ACCOMPANYING DRAWINGS

Reference will hereinafter be made to the accompanying drawings wherein like reference numerals denote like elements throughout the various figures, and wherein.

Figure 1:
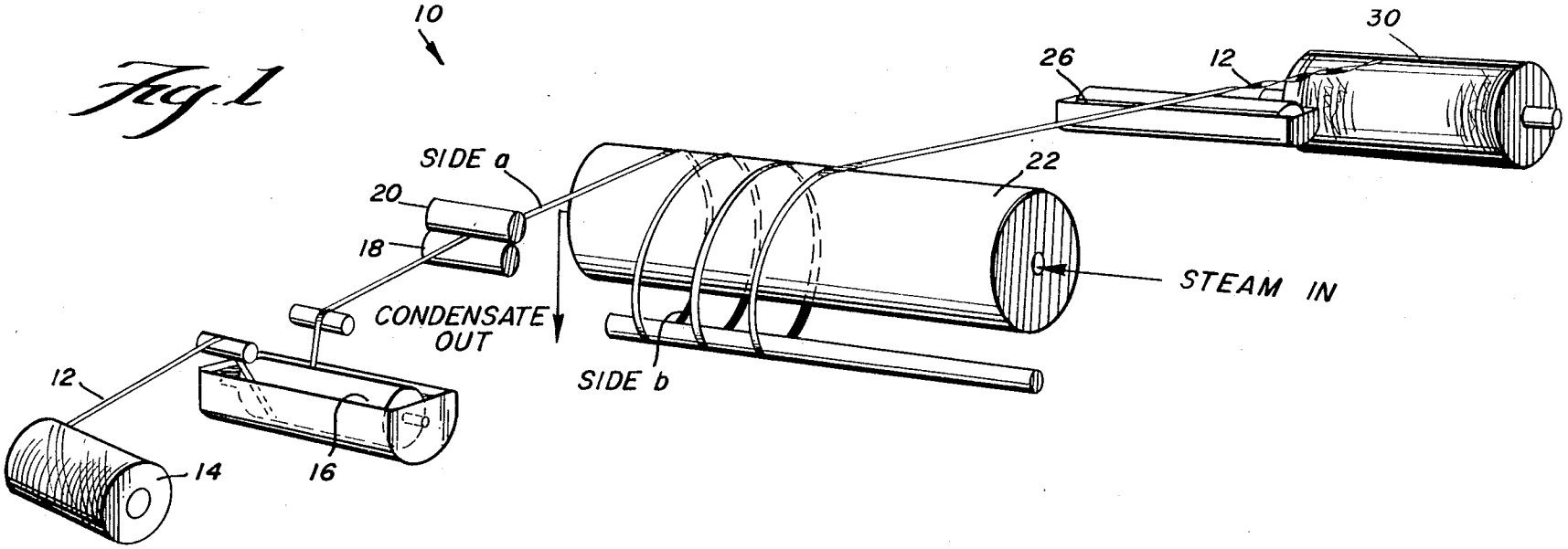
FIG. 1 is a schematic perspective view showing a preferred apparatus of the present invention for coloring textile yarns.

DETAILED DESCRIPTION OF THE PREFERRED EXEMPLARY EMBODIMENT OF THE PRESENT INVENTION

The process for producing a striated or tone-on-tone colored textile yarn is dependent on the ability of the colorant component of the liquid to migrate to specific areas of the yarn. The term "migration" as used herein is meant to refer to the movement of dye or pigment from one area of the yarn or fabric to another. Many factors have been found to influence colorant migration, including the affinity of the yarn for the dye or pigment, the nature of the dyes or pigments involved, the nature of the finish components, the manner in which the finish is applied, and most important, the manner in which the material is dried and the drying temperature.

For example, since glass yarns do not have a natural affinity for dyes or pigments, it is preferred to use a water-based resin bonded pigment system to color the glass yarns since the resin or binder holds the pigments on the glass filaments. The technique for dying glass yarns is not unlike that of painting except that a pigmented resin bath for textile purposes is more fluid compared to a latex paint and the bath components are selected for desired effects.

Various resins or binders may be advantageously used according to the present invention including polymers or copolymers of polyvinylchloride, polyvinylacetate, polyvinyl acrylates and latexes of butadiene styrene, polyester, polyethylene vinyl acetate, chlorinated polyethylene vinyl acetate, water based silicone elastomers or any combination of these. Particularly preferred binders are selected from the acrylic copolymer group typically termed acrylic resins or latex resins. Acrylic latexes have good adhesion to glass, are noted for good heat stability and lightfastness, and are also good pigment binders. A wide variety of acrylic latexes are commercially available and may be selected for specific properties such as a soft hand, durability to washing or drycleaning, or for abrasion resistance.

When using glass sliver yarns, the acrylic latex chosen may affect the degree of color migration. If the acrylic latex is cationic in nature, it will have an affinity for the negatively charged glass surface and be less prone to migrate. If the acrylic is too reactive at low temperatures, it may cure before the moisture is completely removed and before adequate migration is achieved. Preferred acrylic latexes should therefore be anionic or non-ionic in nature and should not cure at temperatures below 250° F. At 250° F., the water will have evaporated and pigment migration will essentially be complete. The concentration of the acrylic latex may also influence migration. A pigmented resin bath of 95 percent acrylic latex resin and 5 percent pigments will tend to migrate considerably less than a bath consisting of 4 percent resin and 5 percent pigments when processed in a similar manner. Preferred concentrations of acrylic resin for treating e.g. glass sliver yarns according to the process of the present invention range from between about 2–25 percent (based upon the weight of the solids in the bath) with a more preferred range of between about 4–10 percent.

The primary purpose of the pigments is, of course, to achieve a desired color. Organic pigments with good lightfastness including the phthalocyanine blues and greens, quinacridone reds, benzidine yellows, and carbon blacks are particularly preferred. Inorganic pigments including iron oxide yellows, iron oxide reds, cadmium or chrome yellows and cobalt blues may also be used, but such inorganic pigments migrate under the conditions of the present invention to lesser degree than organic pigments.

Auxiliary chemicals may be added to the resin bath for improved processing or for added properties. Softners including polyethylene emulsions, silicones, expoxidized soybean oil and waxes may be added to improve the final hand of the yarn. It is often desirable with glass yarns to add small amounts of a silane coupling agent to help bond the resin and pigments to the glass surface for improved durability to cracking, abrasion, and washing. Wetting agents, defoamers, delustering agents, fluorochemicals for water and stain repellancy, and various hand modifiers may be added to achieve desired results. These additives should not be used in excess otherwise the migration properties of the pigments in the bath may be masked.

An exemplary pigmented resin bath formulation suitable for use in the present invention includes:

| Bath Component | Weight percent Based on Total Weight of Bath |
|---|---|
| silane coupler | 0.1-1.0% |
| wetting agent | 0.2-1.0 |
| softener | 0.5-2.0 |
| antifoam | 0.05-0.2 |
| humectant | 0.2-1.0 |
| acrylic resin | 2.0-15.0 |
| pigments | 0.1-5.0 |
| water | 60.0-95.0 |

Particularly preferred yarns suitable for coloring by the process and apparatus of this invention include glass sliver yarns. A glass sliver yarn is a collection of numerous strands of glass filaments. A particularly suitable glass sliver yarn is identified as 666 TEX and is manufactured by The Schuller Company in Europe and can be commercially obtained in the United States from Manville Sales Corporation. The 666 TEX yarn consists of numerous glass filaments having a nominal diameter of 10 microns and lengths of 18-24 inches. When these filaments are collected into a single strand, a yarn with a fluffy and almost texturized appearance is produced with random vairations in the diameter and bulkiness of the yarn. Another suitable glass sliver yarn is 333 TEX which has a diameter size about one-half that of the 666 TEX yarn.

Although reference has been made and will hereinafter be made to glass sliver yarns as the particularly preferred yarns for treatment in accordance with the present invention, favorable results are also achieved when utilizing natural yarns (e.g. cotton), synthetic yarns (e.g. polyester or nylon) or blends thereof. The particular colorant-containing bath utilized will of course depend upon the type of textile yarn being treated. It may thus be desirable to use a nonresinous dyestuff bath with certain textile yarns. The selection of a particular colorant-containing liquid for treating particular textile yarns is believed well within the skill of those in this art.

FIG. 1 shows a dyeing apparatus 10 which is particularly suitable for the practice of the present invention and for describing the sequence of the processing steps involved. The untreated yarn 12 is creeled from a standard yarn package 14 and passed into bath 16 containing the colorant liquid (hereinafter termed "finish"). Excess finish is squeezed from yarn 12 by rubber pad rolls 18,20 and the wet yarn is then passed onto a heated cylinder 22 which is preferably driven by any suitable means (not shown) to effect movement of the yarn through the various processing stations. The side of the yarn 12 facing away from the cylinder 22 is identified in the accompanying figures as "side a" while the side in direct contact with the cylinder 22 is identified as "side b". While the surface temperature of the cylinder is substantially uniform, the yarn itself is not dried uniformly. Side b of yarn 12 which is in contact with the heated cylinder 22 begins to dry first. As side b dries, the finish and colorants from other portions of the yarn including the center and side a of the yarn 12 migrate towards these initial dry areas. Further drying and migration of the finish occur due to the continued contact of side b with cylinder 22. Side b thus exhibits a darker color hue when compared to side a due to the finish migration thereto by virtue of the contact of side b with heated cylinder 22.

Of course, the yarn 12 does not dry immediately nor is colorant migration instantaneous. For that reason, the yarn 12 is preferably maintained in contact with the heated surface of cylinder 22 until drying of yarn 12 is complete. Since the cylinder 22 is usually not large enough in diameter to complete drying of the yarn 12 in one revolution, the yarn 12 is preferably spiralled on the cylinder 22 for a number of turns. After each turn, the yarn 12 is pulled from cylinder 22 by an offset tensioning roll 24 which aids in tracking the yarn on the cylinder 22.

Side b of yarn 12 is always disposed in contact with the heated cylinder 22 and therefore, the finish and colorants will always migrate towards the cylinder 22 (e.g. from side a to side b). There is little tendency for the yarn 12 to twist on the cylinder 22 since there is sufficient tension by virtue of offset roll 24 to maintain the yarn 12 against cylinder 22. If desired, a small amount of wax for improved weaving lubricity can be applied to yarn 12 by means of a kiss roll 26 before the yarn is wound onto a package 30.

Some twisting of yarn 12 may naturally occur when it is wound onto package 30. Additional twisting of yarn 12 could be achieved, if desired by suitable mechanical twisting means (not shown) so as to further randomly distribute the drker color hue of side b along the length of yarn 12. Thus package 30 may itself exhibit a heather-like appearance from random portions of side b being exposed due to such twisting. Of course, twisting means could also be positioned adjacent to a weaving machine so as to effect desired twisting of yarn 12 when creeled from package 30 during fabric production, if desired.

Figure 2:
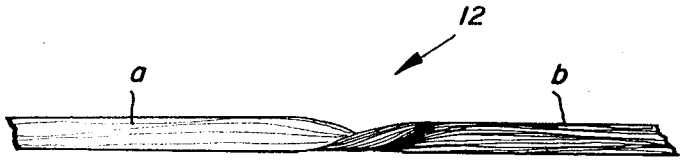
FIG. 2 is a schematic representation of a single glass sliver yarn, partially twisted, showing dark and light pigmented areas achieved by the present invention.

FIG. 2 schematically depicts an exemplary glass sliver yarn 12 colored by the process of the present invention, the yarn 12 being illustrated in a twisted state to show that side b is darker than side a.

Figure 3:
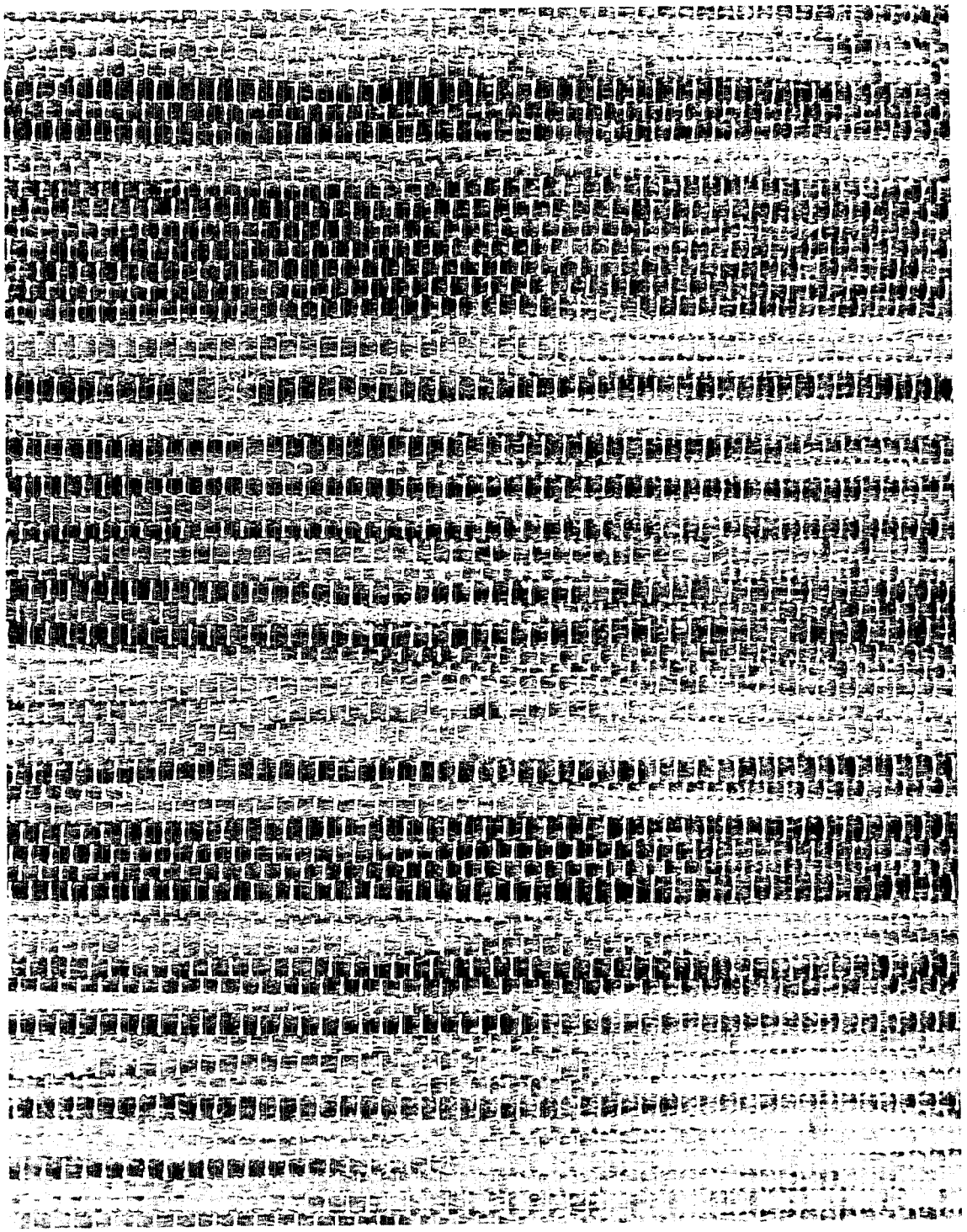
FIG. 3 is a photograph of a fabric sample woven with the yarn schematically depicted in FIG. 2.

A fabric woven with yarn 12 as f iller in the cross machine direction is shown in accompanying FIG. 3. In weaving, the yarn of the present invention has a tenency to further twist or turn as it is inserted as fill into the fabric and thus different portions of the upper and lower yarn surfaces are visible on the farbic face. In effect, therefore, the twisting randomizes the dark and light color hues of the upper and lower yarn surfaces to give the pleasing heather-like appearance to the woven fabric. As noted above, twisting of the yarn may also occur as the yarn is transferred from the cylinder 22 to package 30.

The temperature of the heated cylinder 22 is an important factor in determining the degree of colorant migration and thus ultimately the degree of contrast between the dark and light areas in the colored yarn. Too low a surface temperature will result in little, if any, migration since the yarn would effectively be dried uniformly. Uniform drying of the yarn is to be avoided in accordance with the present invention. Too high a temperature on the other hand may destabilize the finish on the wet yarn and, for example, may cause the colorant to separate from the glass yarn surface when glass sliver yarns are utilized. The high temperature may also discolor some of the finish components or the starch-based binder typically applied to some yarns during manufacturing. A preferred range of temperatures for colorant migration to occur in accordance with the present invention is about 250 degrees to about 450 degrees Farenheit and an even more preferred temperature range is between about 300 degrees to about 350 degrees Farenheit.

Cylinder 22 shown in accompanying FIG. 1 preferably has a diameter of about 30 inches although larger or smaller diameters can be employed, if desirable. The surface of cylinder 22 is heated by means of steam in accordance with well known techniques. Depending on the steam pressure utilized, temperatures of 300–350 degrees Farenheit can be obtained and controlled without difficulty employing control techniques believed well known to those in this art.

The present invention will be further understood by reference to the following non-limiting examples.

EXAMPLE I

In the following example, a pigmented resin bath of the below formulation was utilized:

380 grams—A-187 silane (Union Carbide)
500 grams—Ammonia (28% concentrated)
40 grams—Antifoam DB-110 (Dow Corning)
1000 grams—Dyescour HS (Burlington Industries)
4 gallons—Rhoplex TR-934 (Rohm & Haas)
1020 grams—Imperon Yel QGL (American Hoechst)
257 grams—Imperon Red KGC (American Hoechst)
125 grams—Imperon Black QRA (American Hoechst)
45 gallons—Water A 666 TEX glass sliver yarn obtained from Manville Sales Corporation, Denver, Colorado was padded with the above resin bath formula on an apparatus similar to that shown in accompanying FIG. 1 at a pad pressure of 25 lbs/sq. in. The heated cylinder 22 (steam can) was set at a temperature of 310° F. and the yarn was wrapped around the cylinder for the requred number of turns so as to be in contact with the heated cylinder for a period of 2 minutes. The completely dried and cured yarn was then wound onto a package.

The treated yarn was observed to be beige-tan in color and was about 30% darker in color on one side (e.g. the side that came into contact with the heated cylinder) when compared to the other side. When the yarn treated in this example was woven into a fabric style identified as Burlington Industries S/16003/666 (see FIG. 3), the result was a fabric exhibiting a highly striated or tone-on-tone tan color.

EXAMPLE II

A pigmented resin bath of the below composition was used:

190 grams—A-187 Silane (Union Carbide)
250 grams—Ammonia (28% concentrated)
20 grams—Antifoam DB-110 (Dow Corning)
500 grams—Dyescour HS (Burlington Industries)
2 gallons—Phoplex TR-934 (Rohm & Haas)
1020 grams—Imperon QGL (American Hoechst)
257 grams—Imperon Red KGC (American Hoechst)
125 grams—Imperon Black QRA (American Hoechst)
45 gallons—Water The following textile yarns were each brought into contact with the above-formulated pigmented liquid bath and dried in a manner similar to Example I above with running times (i.e. time in contact with the heated cylinder) adjusted to account for variance in the amount of pigmented liquid absorbed:

| Yarn No. | Type |
|---|---|
| 1 | 100% Polyester Roving 1.10 HR |
| 2 | 60/40 Cotton/Polyester Roving 2.75 HR |
| 3 | Nylon Carpet Yarn - Code 8534, Anso 1V, HP, 7K51, Comingled, Tritone, (Allied) Bright BCF Nylon with Halofresh, 3840/1 filament |
| 4 | Nylon Carpet Yarn - 4000/1 filament, Antron, 362A (DuPont), Code 9377 |

Visual inspection revealed that each yarn nos. 1–4 exhibited a beige-tan color and was significantly darker on that portion of the yarn which came into contact with the heated cylinder. Although the amount of pigment migration varied among the yarn nos. 1–4, each exhibited a visually perceptible color hue difference thereby rendering such yarns suitable for forming woven fabrics having a striated appearance similar to FIG. 3.

It is understood that various modifications will be apparent to those skilled in the art without departing from the scope and spirit of this invention. For example, other methods of drying the yarn, such as electrical heat, may be utilized to induce and encourage migration of the pigments. The colorant liquid bath may also be applied by means other than padding, for example, by spraying, kiss-coating, or printing onto the yarn.

What is claimed is:

1. A method of producing a colored textile yarn comprising the steps of:

(a) applying a colorant-containing liquid to the surface of the textile yarn; and (b) unevenly heating the textile yarn to cause the colorant in the liquid to substantially migrate toward the source of heat to thereby produce a colored yarn having one portion that is visibly darker in color hue when compared to another portion of the yarn.

2. A method as in claim 1 wherein step (a) is practiced by bringing the yarn into contect with a bath having the colorant-containing liquid contained therein.

3. A method as in claim 1 or 2 wherein step (b) is practiced by the steps of:

(i) providing a drum having a cylindrical outer surface;

(ii) heating the drum surface; and (iii) bringing the one portion of the yarn into contact with the heated drum surface so that the one portion of the yarn is dried at a rate faster than the other portion of the yarn to thereby cause the colorant to migrate to the one portion.

4. A method as in claim 3 wherein step (ii) is practiced by heating the drum durface to between about 250° F. to about 450° F.

5. A method as in claim 3 wherein step (ii) is practiced by heating the drum surface to between about 300° F. to about 350° F.

6. A method as in claim 1 wherein said textile yarn is a natural textile yarn.

7. A method as in claim 6 wherein said yarn is cotton.

8. A method as in claim 1 wherein said textile yarn is a synthetic textile yarn.

9. A method as in claim 8 wherein said yarn is at least one selected from polyester and nylon.

10. A method as in claim 1 wherein said textile yarn is a blend of natural and synthetic yarns.

11. A method of coloring textile yarn so as to produce yarn having a darker color hue on one side thereof when compared to the other side of the yarn, said method comprising the steps of:

(a) applying a colorant-containing liquid to the surfaces of said one and other sides of the yarn;

(b) drying said one side of the yarn at a drying rate which is faster than the drying rate of said other side of the yarn to establish a drying rate gradient between said one and other sides; and (c) allowing the colorant in the liquid applied according to step (a) to migrate to said one side of the yarn by virtue of the drying rate gradient established according to step (b), said migration effecting a darker color hue on said one side when compared to said other side.

12. A method as in claim 11 wherein step (a) is practiced by bringing the yarn into contact with a bath having the colorant-containing liquid contained therein.

13. A method as in claim 11 wherein step (b) is practiced by the steps of:

(i) providing a drum having a cylindrical outer surface;

(ii) heating the drum surface; and (iii) bringing the one side of the yarn into contact with the heated drum surface so that the one side of the yarn is dried at a rate faster than the other side of the yarn to thereby cause the colorant to migrate to the one yarn side.

14. A method as in claim 13 wherein step (ii) is practiced by heating the drum surface to between about 250° F. to about 450° F.

15. A method as in claim 11 wherein said colorant-containing liquid consists essentially of an organic pigment and at least one resin component selected from the group consisting of polymers and copolymers of polyvinyl chloride, polyvinylacetate, polyvinylacrylate, and latexes of butadiene syrene, polyester, polyethylene vinyl acetate, chlorinated polyethylene vinyl acetate, and water based silicone elastomers.

16. A method as in claim 15 wherein said textile yarn is a glass sliver yarn.

17. A method as in claim 11 wherein said colorant-containing liquid is a liquid dye solution.

18. A method as in claim 11 wherein said liquid consists essentially of an organic pigment and an acrylic resin.

19. A method as in claim 18 wherein the organic resin is present between about 0.1 to about 5.0 percent by weight.

20. A method as in claim 18 wherein the acrylic resin is present between about 2 to about 25 percent by weight.

21. A method as in claim 18 wherein the acrylic resin is present between about 4 to about 10 percent by weight.

22. A method as in claim 18 wherein the acrylic resin is present between about 2 to about 15 percent by weight.

23. A method of coloring a textile yarn having upper and lower yarn surfaces so that the lower yarn surface exhibits a visually perceptive darker color hue when compared to the upper yarn surface, said method comprising the steps of:

(a) coating the upper and lower surfaces of the yarn with a colorant-containing liquid;

(b) bringing the lower yarn surface into contact with a heated surface so that the lower yarn surface is dried at a rate faster than the upper yarn surface; and (c) allowing the colorant in the liquid applied to the yarn according to step (a) to migrate to the lower yarn surface by virtue of the faster drying rate thereof, said migration being in an amount sufficient to produce a visually perceptive darker color hue on the lower yarn surface when compared to the upper yarn surface.

24. A method as in claim 23 wherein step (b) is practiced according to the steps of:

(i) providing a drum having an outer cylindrical surface;

(ii) heating the cylindrical surface of the drum; and (iii) bringing the lower yarn surface into contact with the heated cylindrical surface.

25. A method as in claim 23 wherein step (ii) is practiced by heating the drum surface to between about 250° F. to about 450° F.

26. A yarn produced by the method of claim 1, 11 or 23.

27. A method of producing a woven textile fabric comprising the steps of:

(a) coloring textile yarns having upper and lower yarn surfaces so that the lower yarn surface exhibits a visually perceptive darker color hue when compared with the upper yarn surface, said coloring being practiced by the steps of;

(i) applying a pigment-containing liquid to the upper and lower yarn surfaces; and (ii) drying the lower yarn surface at a rate faster than the drying rate of the upper yarn surface to cause the pigments to migrate to the lower yarn surface to a degree sufficient to create a visually perceptive darker color hue on the lower surface when compared to the upper surface;

(b) weaving the colored yarns to form a woven textile fabric.

28. A method as in claim 27 further comprising the step of (c) twisting the colored yarns so that the darker color hue of the lower yarn surface is visually randomly distributed along the length of the yarns.

29. A method as in claim 28 wherein steps (b) and (c) are practiced simultaneously.

30. A woven textile fabric produced by the method of claim 27, 28 or 29.

31. A method of producing a pigmented glass sliver yarn comprising the steps of:

(a) applying a pigment-containing liquid resin to the surface of the textile yarn; and (b) unevenly heating the testile yarn to cause the pigments in the liquid resin to substantially migrate toward the source of heat to thereby produce a pigmented yarn having one side that is visibly darker in color hue when compared to the other side of the yarn.

32. A method as in claim 31 wherein step (a) is practiced by bringing the yarn into contact with a bath having the pigment containing liquid contained therein.

33. A method as in claim 31 or 32 wherein step (b) is practiced by the steps of:

(i) providing a drum having a cylindrical outer surface;

(ii) heating the drum surface; and (iii) bringing the one side of the yarn into contact with the heated drum surface so that the one side of the yarn is dried at a rate faster than other side of the yarn to thereby cause the pigment to migrate to the one yarn side.

34. A method as in claim 33 wherein step (ii) is practiced by heating the drum surface to between about 250° F. to about 450° F.

35. A method as in claim 33 wherein step (ii) is practiced by heating the drum surface to between about 300° F. to about 350° F.

36. A method of coloring glass sliver yarn so as to produce yarn having a darker color hue on one side thereof when compared to the other side of the yarn said method comprising the steps of:

(a) applying a pigmented liquid resin to the surfaces of said one and other sides of the yarn;

(b) drying said one side of the yarn at a drying rate which is faster than the drying rate of said other side of the yarn to establish a drying rate gradient between said one and other sides; and (c) allowing the pigment in the liquid resin applied according to step (a) to migrate to said one side of the yarn by virtue of the drying rate gradient established according to step (b), said migration effecting a darker color hue on said one side when compared to said other side.

37. A method as in claim 36 wherein step (a) is practiced by bringing the yarn into contact with a bath having the pigment-containing liquid contained therein.

38. A method as in claim 36 or 37 wherein step (b) is practiced by the steps of:

(i) providing a drum having a cylindrical outer surface;

(ii) heating the drum surface; and (iii) bringing the one side of the yarn into contact with the heated drum surface so that the one side of the yarn is dried at a rate faster that the other side of the yarn to thereby cause the pigment to migrate to the one yarn side.

39. A method as in claim 38 wherein step (ii) is practiced by heating the drum surface to between about 250° F. to about 450° F.

40. A method as in claim 38 wherein step (ii) is practiced by heating the drum surface to between about 300° F. to about 350° F.

41. A method as in claim 37 wherein said liquid consists essentially of an organic pigment and at least one resin component selected from the group consisting of polymers and copolymers of polyvinyl chloride, polyvinylacetate, polyvinylacrylate, and latexes of butadiene styrene, polyester, polyethylene vinyl acetate, chlorinated polyethylene vinyl acetqate, and water based silicone elastomers.

42. A method as in claim 36 wherein said liquid consists essentially of an organic pigment and an acrylic resin.

43. A method as in claim 36 wherein the organic resin is present between about 0.1 to about 5.0 percent by weight.

44. A method as in claim 42 or 43 wherein the acrylic resin is present between about 2 to about 25 percent by weight.

45. A method as in claim 42 or 43 wherein the acrylic resin is present between about 4 to about 10 percent by weight.

46. A method as in claim 42 or 43 wherein the acrylic resin is present between about 2 to about 15 percent by weight.

47. A method of dyeing a glass sliver yarn having upper and lower yarn surfaces so that the lower yarn surface exhibits a visually perceptive darker color hue when compared to the upper yarn surface, said method comprising the steps of:

(a) coating the upper and lower surfaces of the yarn with a pigment-containing liquid resin;

(b) bringing the lower yarn surface into contact with a heated surface so that the lower surface is dried at a rate faster than the upper yarn surface; and (c) allowing the pigments applied to the yarn according to step (a) to migrate to the lower yarn surface by virtue of the faster drying rate thereof, said migration being in an amount sufficient to produce a visually perceptive darker color hue on the lower yarn surface when compared to the upper yarn surface.

48. A method as in claim 47 wherein step (b) is practiced according to the steps of:

(i) providing a drum having an outer cylindrical surface;

(ii) heating the cylindrical surface of the drum; and (iii) bringing the lower yarn surface into contact with the heated cylindrical surface.

49. A method as in claim 48 wherein step (ii) is practiced by heating the drum surface to between about 250° F. to about 450° F.

50. A method as in claim 48 wherein step (ii) is practiced by heating the drum surface to between about 300° F. to about 350° F.

51. A woven textile fabric produced with the yarn of claim 31, 36 or 47.

52. A method of producing a woven textile fabric having randomly distributed color hue variations comprising the steps of:

(a) coloring glass sliver yarns having upper and lower yarn surfaces to that the lower yarn surface exhibits a visually perceptive darker color hue when compared with the upper yarn surface, said coloring being practiced by the steps of;

(i) applying a pigment-containing liquid resin to the upper and lower yarn surfaces; and (ii) drying the lower yarn surface at a rate faster than the drying rate of the upper surface to cause the pigments to migrate to the lower yarn surface to a degree sufficient to create a visually perceptive darker color hue on the lower surface when compared to the upper surface;

(b) twisting the yarns colored according to the step (a) so that the darker color hue of the lower yarn surfaces is visually randomly distributed along the length of the yarns; and (c) weaving the twisted yarns to form a woven textile fabric.

53. A method as in claim 52 wherein steps (b) and (c) are practiced simultaneously.

* * * * *